US005610347A

United States Patent [19]

Behrens et al.

[11] Patent Number: 5,610,347

[45] Date of Patent: Mar. 11, 1997

[54] MATERIAL FOR ELECTRIC CONTACTS TAKING SILVER-TIN OXIDE OR SILVER-ZINC OXIDE AS BASIS

[75] Inventors: Volker Behrens, Bretten; Thomas Honig, Tiefenbronn; Andreas Kraus, Mühlacker; Karl E. Saeger, Pforzheim; Rainer Schmidberger, Markdorf; Theodor Staneff, Bermatingen, all of Germany

[73] Assignee: Doduco GmbH & Co. Dr. Eugen Durrwachter, Pforzheim, Germany

[21] Appl. No.: 356,222

[22] PCT Filed: Jun. 9, 1993

[86] PCT No.: PCT/EP93/01453

§ 371 Date: Feb. 21, 1995

§ 102(e) Date: Feb. 21, 1995

[87] PCT Pub. No.: WO93/26021

PCT Pub. Date: Dec. 23, 1993

[30] Foreign Application Priority Data

Jun. 10, 1992 [DE] Germany ..... 42 19 333.8
Apr. 7, 1993 [DE] Germany ..... 43 11 399.0

[51] Int. Cl.[6] ..... C22C 5/06

[52] U.S. Cl. ..... 75/247; 75/234; 75/237; 75/233

[58] Field of Search ..... 75/233, 234, 237, 75/247

[56] References Cited

U.S. PATENT DOCUMENTS

| | | | |
|---|---|---|---|
| 3,933,485 | 1/1976 | Shibata | 75/173 R |
| 4,023,961 | 5/1977 | Douglas et al. | 75/0.5 AC |
| 4,131,458 | 12/1978 | Satoh et al. | 75/173 R |
| 4,141,727 | 2/1979 | Shida et al. | 75/232 |
| 4,150,982 | 4/1979 | Shibata | 75/173 A |
| 4,396,420 | 8/1983 | Schmidberger et al. | 75/0.5 AL |
| 4,698,096 | 10/1987 | Schmidberger et al. | 75/248 |
| 5,160,366 | 11/1992 | Shibata . | |
| 5,286,441 | 3/1994 | Shibata | 419/21 |
| 5,360,673 | 11/1994 | Mayer et al. | 428/546 |
| 5,429,656 | 7/1995 | Hauner et al. | 75/232 |

FOREIGN PATENT DOCUMENTS

| | | |
|---|---|---|
| 0024349 | 8/1980 | European Pat. Off. . |
| 0039429 | 4/1981 | European Pat. Off. . |
| 0056857 | 12/1981 | European Pat. Off. . |
| 0182386 | 1/1984 | European Pat. Off. . |
| 0369283 | 11/1989 | European Pat. Off. . |

*Primary Examiner*—Charles T. Jordan
*Assistant Examiner*—Daniel Jenkins
*Attorney, Agent, or Firm*—Dvorak and Traub

[57] ABSTRACT

The invention relates to a material for electric contacts taking silver tin-oxide as basis, consisting of silver or mainly silver-containing alloy, tin oxide and other oxides or carbides of tungsten, molybdenum, vanadium, bismuth, titanium, and/or copper.

50 Claims, 2 Drawing Sheets

TEMPERATURE RISE AT PERMANENT CURRENT
NOVEL MATERIAL $Ag/SnO_2*MoO_3$ WITH 42 ppm $MoO_3$-CONTENT
88/12

AFTER 200.000 SWITCHING CYCLES AC1, 37 kW-CONTACTOR

TEMPERATURE RISE AT PERMANENT CURRENT
NOVEL MATERIAL $Ag/SnO_2*MoO_3$ WITH 42 ppm $MoO_3$-CONTENT
88/12
AFTER 200.000 SWITCHING CYCLES AC1, 37 kW-CONTACTOR TEMPERATURE RISE AT PERMANENT CURRENT
CONVENTIONAL POWDER-METALLURGICAL MATERIAL $Ag/SnO_2/MoO_3$
88/11.6/0.4
AFTER 200.000 SWITCHING CYCLES AC1, 37 kW-CONTACTOR

MATERIAL FOR ELECTRIC CONTACTS TAKING SILVER-TIN OXIDE OR SILVER-ZINC OXIDE AS BASIS

BACKGROUND OF THE INVENTION

The invention relates to a material for electric contacts taking silver tin-oxide as basis, consisting of silver or a mainly silver-containing alloy, tin oxide and other oxides or carbides of tungsten, molybdenum, vanadium, bismuth, titanium, and/or copper. Such material is known from patent WO 89/09478.

Because of their better environmental compatibility and their at least partly more favorable service life, the contact materials with silver tin oxide have begun to replace the previously preferred silver cadmium-oxide materials. However, because of its higher thermal properties, tin-oxide's tendency under arcing effect to form poorly conducting clinker layers on the surface, at constant current, the thermal behavior of silver tin-oxide contacts is unsatisfactory. In order to remedy this unsatisfactory property, to the generally powder-metallurgically produced material are added powdered admixtures that lead to a lower temperature at the contact points. As appropriate admixtures, the patents disclose especially tungsten and molybdenum compounds (DE-A-29 33 338, DE-A- 31 02 067, DE-A-32 32 627, EP-A-0024349). Bismuth and germanium compounds were further disclosed as admixtures (DE-A-31 02 067 and DE-A-32 627). These admixtures help to wet tin-oxide particles, so that the tin oxide remains finely divided in suspension when the contact piece surface melts under the effect of a contact arcing. Beside this positive effect in respect to the thermal behavior under constant current, these admixtures have, however, undesirable secondary effects. The less than satisfactory plastic deformation of the silver tin-oxide contact materials for the improvement of which the tin-oxide powder is subject, by way of example, to a pre-treatment by calcining (DE-A-29 52 128), is further worsened by the admixtures because of their embrittling effect. This applies especially to the bismuth and molybdenum oxides. Another disadvantage, particularly of the tungsten and molybdenum compounds, is that—especially in switching operation under ACI stress (DIN 57660 Section 102)—they contribute to a transfer of material, leading to an accelerated burn-off and thus to a shortened service life.

As disclosed in WO 89/09478, a material for contacts presenting a low welding tendency and the lowest possible contact temperature can be obtained by purposefully producing a structure in which areas containing little or no metal oxide alternate with areas that contain the entire metal oxide component, or the preponderant portion thereof, in minute distribution. For this purpose, a composite powder is produced that contains the preponderant part of the tin oxide and the other oxides and/or carbides, as well as a portion of the silver. This composite powder is mixed, condensed, sintered, and transformed with the remaining silver powder and eventually with the remaining part of the metal oxides. Although a suitable material is obtained in this manner, it is achieved by using a rather costly method.

The patent EP-A 0 369 283 discloses a sintered contact material for low-voltage switch gears used in power engineering, in particular for motor contactors, the composition $AgSnO_2Bi_2O_3CuO$. This composition is produced by the internal oxidation of an AgSnBiCu alloyed powder that is mixed, compressed and sintered with a lesser amount of bismuth-zirconate and/or bismuth- titanate powder. This process reduces the strength of the $AgSnO_2Bi_2O_3CuO$ particles at the edge of the oxides, so that between the particles is created a silver network that allows for high compressed densities. However, both the manufacture of the alloy powder as well as its internal oxidation are costly and render the method quite expensive.

The object of this invention is to produce a material of the initially stated type, that through the means of oxidic or carbidic admixtures presents a thermal behavior that is as advantageous as the known materials for [electric] contacts without, however, being as brittle.

SUMMARY OF THE INVENTION

According to the invention, this object is solved by a material presenting the characteristics set forth in claims 1 or 2. Further advantageous embodiments of the invention are the objects of the subclaims.

The invention does not make the obvious attempt to find new admixtures that lower the contact- point temperature without exercising or having a lower embrittling effect. According to the invention, admixtures are used that are already known for this purpose and of which it is known that they have an embrittling effect. According to the invention, however, the chosen admixture is not used as a separate powder in addition to silver powder and tin-oxide powder (DEoA-29 33 338, DE-A-31 02 067, DE-A-32 6127) and also not as a component of a silver-tin oxide composite powder that is mixed with more silver powder and eventually metal oxide powders (WO 89/09478); rather, what is produced is a material containing tin-oxide areas in a matrix consisting of silver or of an alloy mainly consisting of silver, in which are concentrated the other oxides and/or carbides combined with the tin oxide and in which the silver matrix—apart from any possible soluble constituents - is free of the other oxides and carbides. In these tin-oxide areas, the oxides can be present as single-phase mixed oxide or as a two-phase or polyphase oxide mixture (e.g., in a particle compound or a laminar compound). Such a material is preferably produced in a powder-metallurgically manner by mixing a silver powder or a silver alloy powder with a composite powder, in which the other oxides and/or carbides are bound to the tin oxide; molded bodies are then extruded and sintered and, if necessary, redensified or reshaped. It is also possible, however, to mix the composite powder into a smelt of the matrix metal with subsequent solidifying.

Surprisingly, according to the invention, a certain decrease of the contact point temperature under given operating conditions can already be obtained with a lower percentage then previously of the chosen oxidic and/or carbidic admixture to the tin oxide, so that the contact material is less brittle. Another advantage is that, because of the lower percentage of the electrically non-conductive admixture, the electrical resistance of the contact material is further reduced, which also contributes to a decrease of the contact point temperature.

Another advantage of the invention is that, because of the lower percentage of the chosen admixture, the service life of the contact pieces made out of the material is increased, because the admixtures which, such as molybdenum oxide, have the tendency to evaporate under the influence of arcing, thanks to their lower percentage cause less blistering leading thus to a lower burn-off.

Initial experiences with the contact material according to the invention show that a certain decrease of the contact point temperature, according to the invention, can be obtained even with only one fourth to one fifth of the amount of the admixed material which, according to the state-of-the-art, would be necessary for the same decrease of the contact point temperature.

Very little additional oxide or carbide, respectively, is needed if it is seen to it that these admixtures are concentrated in the boundary area of the tin-oxide areas to the silver matrix. Such a material can be obtained by mixing tin-oxide powder with the pulverized admixture and calcining the mixture so that the tin-oxide powder particles are wetted by the admixture and/or a portion of the admixture diffuses into the surface area of the tin-oxide particles, whereby a single-phase mixed oxide (e.g., a new chemical compound) or a two-phase or polyphase oxide mixture can be formed. For a longer service life of contact pieces according to the invention, it is advantageous if the additional oxides and/or carbides are present not only in the boundary area of the tin-oxide areas to the silver matrix but also that the additional oxides and/or carbides are present throughout the tin-oxide areas. Preferably, the tin-oxide composite powder is obtained by using a reaction-spray method, whereby a solution of tin salt and a salt of the metal or of the metals, of whose oxides or carbides the admixture shall consist, is sprayed into a hot, oxidizing atmosphere, in which the salts are thermally disintegrated; thus, a finely divided composite powder is precipitated, in which tin oxide and the oxides or mixed oxides of the alloy are present in a homogenous compound. The reaction-spray method is disclosed, by way of example, in patents DE-C-29 630, U.S. Pat. No. 3,510,291 and EP-A-0 012 202. A carbide-containing tin-oxide composite powder can be obtained by suspending the carbide as a fine powder in the solution to be sprayed. When the suspension is sprayed into a hot, oxidizing atmosphere, the tin oxide and the other oxides settle down on the carbide particles, while the dwell time is held to a minimum so that the reducing effect of the carbide does not exert any influence.

The reaction-spray method can also be advantageously used to obtain a tin-oxide powder, of which the surface is coated with the other oxides, by suspending, as a variation of the above-described method, a finely divided tin-oxide powder in the saline solution instead of the tin salt, and by spraying this suspension into a hot, oxidizing atmosphere.

Finally, it is also possible to suspend in a solution a part of the oxides, to which tin oxide can also belong, and eventually also carbides that shall be contained in the material as admixture; this solution contains the metals for the remaining oxide component of the material and the thus formed solution is sprayed according to reaction-spray method. In such a manner it is possible to produce composite powders with a variety of modified structures, adapted for the specific application of the contact material.

In order to guarantee the assurance against a fusing of the contact pieces that is required from the silver-metal oxide materials, the material contains advantageously 5 to 20 weight per cent, preferably 8 to 15 weight per cent of tin oxide; in order to maintain the tin oxide through the admixtures in suspension in the molten phase occurring under arcing effect, the tin-oxide powder should contain 0.01 to 10 weight per cent of the other oxidic or carbidic admixture, advantageously, however, not more than 5 weight per cent. In view of the fact that the material shall be as least brittle as possible, the admixture of the other oxides and carbides is chosen as low as possible, so as not to exceed a contact-point temperature given under the predetermined conditions of application, for which suffice considerably lower amounts than for the state-of-the art. Preferably, a tin-oxide powder is used that contains only 0. 1 to 1.5 weight per cent of the other oxide or carbide.

The tin-oxide areas in the material are advantageously smaller than 100 μm, preferably smaller than 10 μm in diameter, but they should not be smaller than 0.5 μm so as not to cause any dispersion strengthening.

An especially preferred admixture is molybdenum because of its particularly advantageous effect on the thermal behavior.

The patent's theory can be applied to contact materials taking silver with zinc oxide as basis. Currently there are practically no admixt is attempted to obtain a decrease of the contact-point temperatures by means of structural measures. By using a tin oxide enriched with other oxides and/or carbides, according to the invention, it is possible to obtain a decrease of the contact-point temperature for this material as well.

DETAILED DESCRIPTION OF THE INVENTION

EXAMPLES

Example 1

Figure 1:
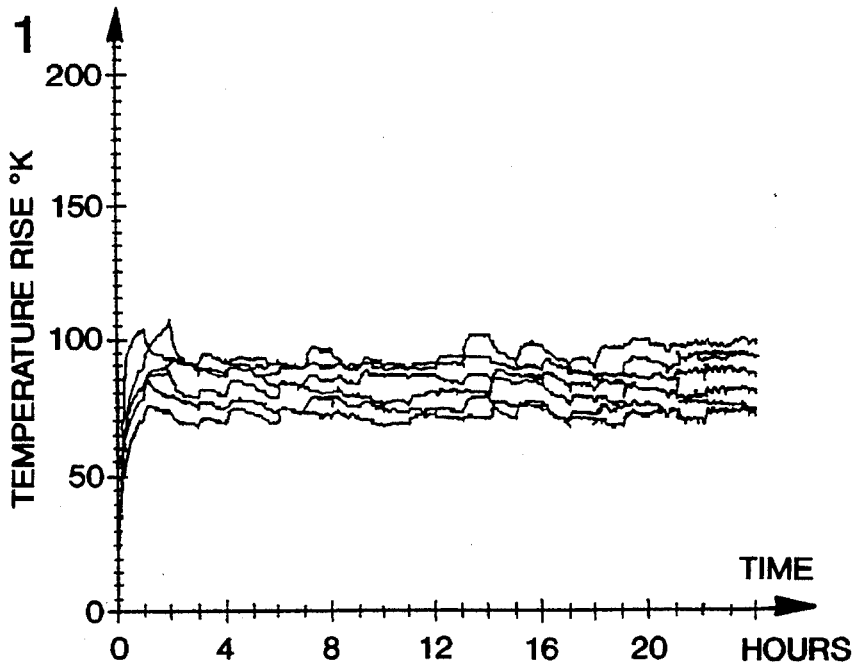
FIG. 1 shows the results of a temperature rise test of an embodiment of the invention.

A tin oxide-molybdenum oxide composite powder with 1 weight per cent molybdenum oxide is produced by spraying an aqueous solution of tin(II)-chloride and molybdenum(IV)-chloride into a reactor with an oxidizing atmosphere, heated to about 950° C.; this process yields a tin oxide-molybdenum oxide composite powder, in whose powder particles are present very finely divided tin oxide and molybdenum oxide.

12 weight per cent parts of the thus produced tin-oxide powder, doped with molybdenum oxide, are thoroughly mixed with 88 weight per cent parts of a silver powder with a particle size of less than 40 μm; from the mixture is isostatically cold-pressed a cylindrical block weighing 50 kg, that is sintered in air and held for ½ hours at a temperature of 820° C. The sintered block is encased in silver, placed hot into a reverse extrusion press and extruded by an extrusion die through a branched extrusion aperture; thus are produced two flat strands that present on one side a silver-tin oxide surface and on the other side a readily solderable and weldable silver surface. Subsequently, the strands are rolled flat and are then 8 cm wide and 2 mm thick.

Example 2

The first example is modified to the effect that, instead of solution consisting of tin(II)-chloride and molybdenum(IV)-chloride, a molybdenum(IV)-chloride solution is sprayed, in which is suspended a tin-oxide powder having a particle size of less than 5 μm.

Contact pieces produced according to example 1 present an increase of the contact point temperature only after a rather large number of switching operations. Presumably, this is connected with the other structure of the tin oxide-molybdenum oxide composite powder, and possibly also with the forming of a mixed oxide.

Example 3

A tin alloy with 2 weight per cent of copper as well as 1 weight per cent of bismuth is heated to a temperature of 580° C. and sprayed by means of a two-component nozzle into a reactor with oxygenous atmosphere, that is at room temperature. According to Fisher, thus is produced a mixed oxide powder with a particle diameter of 4.5 μm. 10 weight per cent of this mixed oxide powder are mixed with a silver powder having a particle diameter of less than 40 μm; from the mixture a cylindrical block is isostatically cold-pressed at a pressure of 7,85.10 n/m$^2$, that is sintered in air for 2 hours at a temperature of 790° C., and subsequently extruded with an extruder, forming a wire with a diameter of 5 mm. By drawing, this wire is tapered down to a diameter of 1.4 mm and subsequently machined to form contact rivets; the diameter of their top is 3.2 mm while the diameter of the shank is 1.47 mm. Being installed in a relay, the new material proved to be markedly superior to the contact materials corresponding to the state-of-the-art when subjected both to the A.C. service life test and the switching of the D.C. lamp load.

Example 4

From an aqueous solution of tin chloride and metatungstic acid is produced a mixed oxide powder by spraying the solution into a reactor that is heated to 1100° C. The tin-tungsten oxide mixture obtained in such a manner has a percentage of tungsten oxide of 1 weight per cent, and a mean particle diameter of 2.4 μm.

As in example 1, the oxide powder is mixed with silver powder and machined to form contact lamellas.

Example 5

An aqueous solution of tin acetate and ammonium heptamolybdate is sprayed into a reactor at a temperature of 800° C.; thus is obtained an oxide powder with a molybdenum content of 350 ppm and a mean particle diameter of 1.9 μm. As in example 1, from this powder is produced a contact material that is subjected to a service life test according to test category AC1 in a switchgear having a power of 37 kW. This service life test is interrupted in order to carry out a temperature-rise test with constant current supply.

Figure 2:
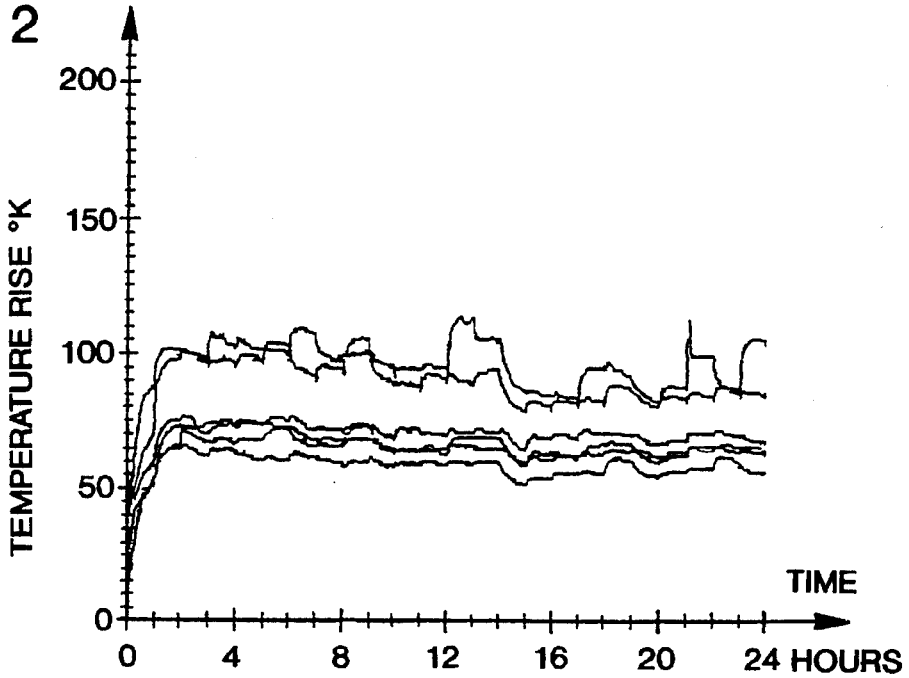
FIG. 2 shows the results of a temperature rise test of the prior art.

FIG. 1 shows the result of this temperature-rise test and it is compared with an analogous test of a material corresponding to the state-of-the-art consisting of 88 weight per cent Ag, 11.6 weight per cent $SnO_2$ and 0.4 weight per cent of $MoO_3$ (FIG. 2).

It can be seen that the thermal behavior of the new material is as good as that of the conventional material although the new material, as regards the entire contact material, presents a molybdenum oxide percentage of merely 42 ppm while, for the same advantageous result, the material corresponding to the state-of-the-art requires a molybdenum percentage of 0.4 weight per cent, i.e., approximately one hundred times as much.

Example 6

Figure 3:
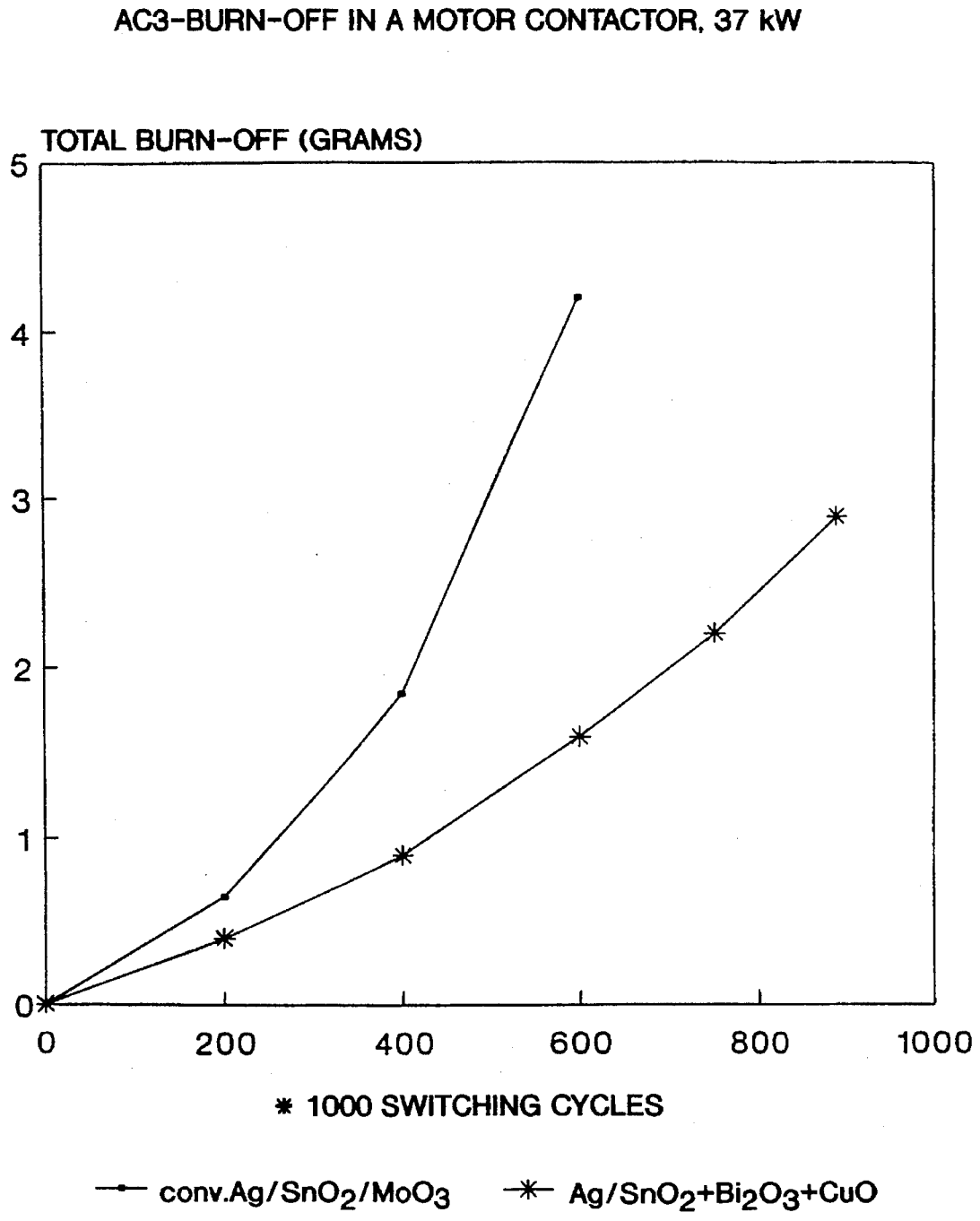
FIG. 3 shows a comparison of the total burn-off of contact pieces as a function of the number of switching cycles for the invention and the prior art.

An aqueous solution of tin chloride, bismuth oxide and copper chloride is sprayed into a reactor with a temperature of 1200° C., and a mixed oxide powder having a bismuth oxide content of 0.8 weight per cent and a copper oxide content of 1.5 weight per cent, as well as mean particle size of 3 μm, is obtained. As in example 1, contact lamellas are produced from this product. In this connection, it can be seen that the new contact material, in contrast to those that are produced by the customary powder-metallurgical method and contain bismuth oxide, is readily deformable. The obtained contact lamellas are subjected to a service life test in a motor contactor according to test category AC3. FIG. 3 shows the total burn-off of the contact pieces as a function of the number of switching cycles for the new material as well as for the one corresponding to the state-of-the-art. As it can be seen, the material consumption of the new material is much less than that of the customary material, a fact that results in an increase of the electrical service life by approximately 50%. It is difficult to produce contact lamellas out of silver-tin oxide-copper oxide-bismuth oxide according to the conventional powder-metallurgical methods, because the embrittling effect of the bismuth oxide leads to fissures when deforming the contact material.

What is claimed is:

1. All electrical contact material comprising:

a metal component as a major ingredient; and the remainder being a meal oxide component as a minor ingredient, said metal component present in the form of a silver matrix, and said metal oxide component present in the form of the oxide particles and one of an other metal oxide/carbide particles selected from the group consisting of molybdenum, tungsten, antimony, germanium, vanadium, and indium, said other carbides/oxides comprising up to 40 percent of a weight percentage of said tin oxide in said material, wherein said silver matrix includes areas of tin oxide and is free of said other oxide/carbide particles, said other oxide/carbide particles confined in a boundary area between said tin-oxide particles and said silver matrix.

2. The electrical contact material of claim 1, wherein said other oxide/carbide particles are also contained within said tin-oxide areas as a homogeneous compound of said tin-oxide and other oxide/carbide particles.

3. The electrical contact material of claim 1 wherein a total fraction of the tin oxide and of the other oxides/carbides amounts to 8 to 20 weight percent of a total weight of the material.

4. The electrical contact material of claim 3, wherein the total fraction of the tin oxide and of the other oxides/carbides amounts to 8 to 15 weight per cent of the total weight of the material.

5. The electrical contact material according to claim 1 wherein the tin-oxide areas are comprised of at least 0.01 weight per cent of the other oxides/carbides.

6. The electrical contact material according to claim 1 wherein the tin-oxide areas contain up to 10 weight per cent of the other oxides/carbides.

7. The electrical contact material of claim 1, wherein the tin-oxide areas contain up to 5 weight per cent of the other oxides/carbides.

8. The electrical contact material of claim 1, wherein the tin-oxide areas contain up to 2.5 weight per cent of the other oxides/carbides.

9. A material according to claim 5, characterized by the fact that the tin-oxide areas contain 0.1 to 1.5 weight per cent of the other oxides and/or carbides.

10. The electrical contact material of claim 1 wherein the homogeneous mixture is obtained by a calcining of a mixture of said tin oxide and other oxide/carbide particles such that said tin oxide particles are wetted by said mixtures such that a portion of said mixture diffuses into the tin-oxide powder particles end produces one of a single and a dual mixed phase oxide compound.

11. The electrical contact material of claim 2, wherein the homogeneous mixture is obtained by spraying a solution of a tin salt, a salt of the metal component, and one of said other oxides/carbides into a hot, oxidizing atmosphere in which the salts are thermally disintegrated, resulting in a precipitation of a finely divided composite powder, the composite powder presenting a homogeneous compound of mixed oxides.

12. The electrical contact material of claim 1, wherein said carbide particles are covered with the tin oxide and the other oxides.

13. The electrical contact material of claim 11, wherein a carbide-containing tin-oxide homogeneous mixture can be obtained by suspending the carbide as a fine powder in the solution to be sprayed.

14. The electrical contact material to claim 1 that is obtained by spraying into a hot, oxidizing atmosphere a suspension of tin oxide said other oxides/carbides that the material shall contain in addition to the tin oxide, in a solution of a salt of the metal, the oxides of which shall be contained in the material as a residual, oxidizing component wherein the salts are thermally converted into oxides and settle onto one of the oxide particles and carbide particles stemming from the suspension.

15. The electrical contact material according to claim 1 wherein the tin-oxide areas have a diameter of less than 100 μm.

16. A material according to claim 15, wherein the tin-oxide areas have a diameter of not more than 10 μm.

17. A material according to claim 1 wherein the tin-oxide areas have a diameter of at least 0.5 μm.

18. A material according to claim 1 wherein the tin is replaced with zinc.

19. An electrical contact material comprising:

a metal component as a major ingredient; and the remainder being a metal oxide component as a minor ingredient, said metal component present in the form of a silver matrix, and said metal oxide component present in the form of a combination of tin oxide and zinc oxide particles and one of an other metal oxide/carbide particles selected from the group consisting of molybdenum, tungsten, antimony, germanium, vanadium, and indium, said other carbides/oxides comprising up to 40 percent of a weight percentage of said combination of tin oxide and zinc oxide in said material, wherein said silver matrix includes areas of a combination of tin oxide and zinc oxide and is free of said other oxide/carbide particles, said other oxide/carbide particles contained in a boundary area between said combination of tin oxide and zinc oxide particles and said silver matrix.

20. The electrical contact material of claim 19 wherein a total fraction of the combination of tin oxide and zinc oxide and of the other oxides/carbides amounts to 8 to 20 weight percent of a total weight of the material.

21. The electrical contact material of claim 20, wherein the total fraction of the combination of tin oxide and zinc oxide and of the other oxides/carbides amounts to 8 to 15 weight per cent of the total weight of the material.

22. The electrical contact material according to claim 19 wherein the combination of tin oxide and zinc oxide areas are comprised of at least 0.01 weight per cent of the other oxides/carbides.

23. The electrical contact material according to claim 19 wherein the combination of tin oxide and zinc oxide areas contain up to 10 weight per cent of the other oxides/carbides.

24. The electrical contact material of claim 19, wherein the combination of tin oxide and zinc oxide areas contain up to 5 weight per cent of the other oxides/carbides.

25. The electrical contact material of claim 19, wherein the combination of tin oxide and zinc oxide areas contain up to 2.5 weight per cent of the other oxides/carbides.

26. The electrical contact material of claim 19 wherein the homogeneous mixture is obtained by a calcining of a mixture of said combination of tin oxide and zinc oxide and other oxide/carbide particles such that said combination of tin oxide and zinc oxide particles are wetted by said mixtures such that a portion of said mixture diffuses into the combination of tin oxide and zinc oxide powder particles end produces one of a single and a dual mixed phase oxide compound.

27. The electrical contact material of claim 19, wherein the homogeneous mixture is obtained by spraying a solution of a tin salt, a salt of the metal component, and one of said other oxides/carbides into a hot, oxidizing atmosphere in which the salts are thermally disintegrated, resulting in a precipitation of a finely divided composite powder, the composite powder presenting a homogeneous compound of mixed oxides.

28. The electrical contact material of claim 19 wherein said carbide particles are covered with the combination of tin oxide and zinc oxide and the other oxides.

29. The electrical contact material of claim 19, wherein a carbide-containing a combination of tin oxide and zinc oxide homogeneous mixture can be obtained by suspending the earbide as a fine powder in the solution to be sprayed.

30. The electrical contact material to claim 19 that is obtained by spraying into a hot, oxidizing atmosphere a suspension of a combination of tin oxide and zinc oxide said other oxides/carbides that the material shall contain in addition to the combination of tin oxide and zinc oxide, in a solution of a salt of the metal the oxides of which shall be contained in the material as a residual, oxidizing component wherein the salts are thermally converted into oxides and settle onto one of the oxide particles and carbide particles stemming from the suspension.

31. The electrical contact material according to claim 21 wherein the combination of tin oxide and zinc oxide areas have a diameter of less than 100 μm.

32. A material according to claim 31, wherein the combination of tin oxide and zinc oxide areas have a diameter of not more than 10 μm.

33. A material according to claim 19 wherein the combination of tin oxide and zinc oxide areas have a diameter of at least 0.5 μm.

34. A material according to claim 19 wherein the tin is replaced with zinc.

35. An electrical contact material comprising:

a metal component as a major ingredient; and the remainder being a metal oxide component as a minor ingredient, said metal component present in the form of a silver matxix, and said metal oxide component present in the form of zinc oxide particles and one of an other metal oxide/carbide particles selected from the group consisting of molybdenum, tungsten, antimony, germanium, vanadium, and indium, said other carbides/oxides comprising up to 40 percent of a weight percentage of said zinc oxide in said material, wherein said silver matrix includes areas of zinc oxide and is free of said other oxide/carbide particles, said other oxide/carbide particles contained in a boundary area between said zinc-oxide particles and said silver matrix.

36. The electrical contact material of claim 35 wherein a total fraction of the zinc oxide and of the other oxides/carbides amounts to 8 to 20 weight percent of a total weight of the material.

37. The electrical contact material of claim 36, wherein the total fraction of the zinc oxide and of the other oxides/carbides amounts to 8 to 15 weight per cent of the total weight of the material.

38. The electrical contact material according to claim 35 wherein the zinc oxide areas are comprised of at least 0.01 weight per cent of the other oxides/carbides.

39. The electrical contact material according to claim 35 wherein the zinc oxide areas contain up to 10 weight per cent of the other oxides/carbides.

40. The electrical contact material of claim 35, wherein the zinc oxide areas contain up to 5 weight per cent of the other oxides/carbides.

41. The electrical contact material of claim 35, wherein the zinc oxide areas contain up to 2.5 weight per cent of the other oxides/carbides.

42. The electrical contact material of claim 35 wherein the homogeneous mixture is obtained by a calcining of a mixture of said zinc oxide and other oxide/carbide particles such that said zinc oxide particles are wetted by said mixtures such that a portion of said mixture diffuses into the zinc oxide powder particles end produces one of a single and a dual mixed phase oxide compound.

43. The electrical contact material of claim 35, wherein the homogeneous mixture is obtained by spraying a solution of a tin salt, a salt of the metal component, and one of said other oxides/carbides into a hot, oxidizing atmosphere in which the salts are thermally disintegrated, resulting in a precipitation of a finely divided composite powder, the composite powder presenting a homogeneous compound of mixed oxides.

44. The electrical contact material of claim 35, wherein said carbide particles are covered with the zinc oxide and the other oxide.

45. The electrical contact material of claim 35, wherein a carbide-containing zinc oxide homogeneous mixture can be obtained by suspending the carbide as a fine powder in the solution to be sprayed.

46. The electrical contact material to claim 35 that is obtained by spraying into a hot, oxidizing atmosphere a suspension of zinc oxide said other oxides/carbides that the material shall contain in addition to the zinc oxide, in a solution of a salt of the metal the oxides of which shall be contained in the material as a residual, oxidizing component wherein the salts are thermally converted into oxides and settle onto one of the oxide particles and carbide particles stemming from the suspension.

47. The electrical contact material according to claim 35 wherein the zinc oxide areas have a diameter of less than 100 μm.

48. A material according to claim 47, wherein the zinc oxide areas have a diameter of not more than 10 μm.

49. A material according to claim 35 wherein the zinc oxide areas have a diameter of at least 0.5 μm.

50. A material according to claim 35 wherein the tin is replaced with zinc.

* * * * *